United States Patent [19]

Kawakami et al.

[11] 3,938,751

[45] Feb. 17, 1976

[54] DEVICE FOR CONTINUOUSLY TREATING WIRES

[76] Inventors: Heijiro Kawakami, Kobe; Yasunobu Kawaguchi, Takarazuka; Hazime Fukinbara, Kobe, all of Japan

[22] Filed: Dec. 21, 1973

[21] Appl. No.: 427,238

[52] U.S. Cl. ..... 242/47.01; 242/47.12

[51] Int. Cl.[2] ..... B65H 51/20

[58] Field of Search ..... 242/47, 47.01–47.13, 242/82, 25 R, 45, 147

[56] References Cited

UNITED STATES PATENTS

| | | | |
|---|---|---|---|
| 2,755,916 | 7/1956 | McIlvried et al. | 242/47.12 |
| 2,874,918 | 2/1959 | Steiber | 242/82 |
| 3,050,267 | 8/1962 | Tragert | 242/47.1 |
| 3,078,055 | 2/1963 | Harris | 242/47.12 |
| 3,099,412 | 7/1963 | Nystrom | 242/47.01 |
| 3,241,780 | 3/1966 | Kitselman | 242/47.12 |

FOREIGN PATENTS OR APPLICATIONS

| | | | |
|---|---|---|---|
| 578,742 | 6/1933 | Germany | 242/47.12 |

*Primary Examiner*—Stanley N. Gilreath
*Attorney, Agent, or Firm*—Norman F. Oblon

[57] ABSTRACT

A device for continuously storing a length of wire to cause it to remain wound for a predetermined period of time found necessary for treatment thereof, wherein two winding drums are provided upon which the wire is wound in series, leaving an intermediate slackened wire portion therebetween, and the ratio of the rotational speed of the two drums is controlled so as to maintain a constant storing amount of the wire or, preferably, to maintain the intermediate slackened portion of the wire constant.

10 Claims, 8 Drawing Figures

FIG.7
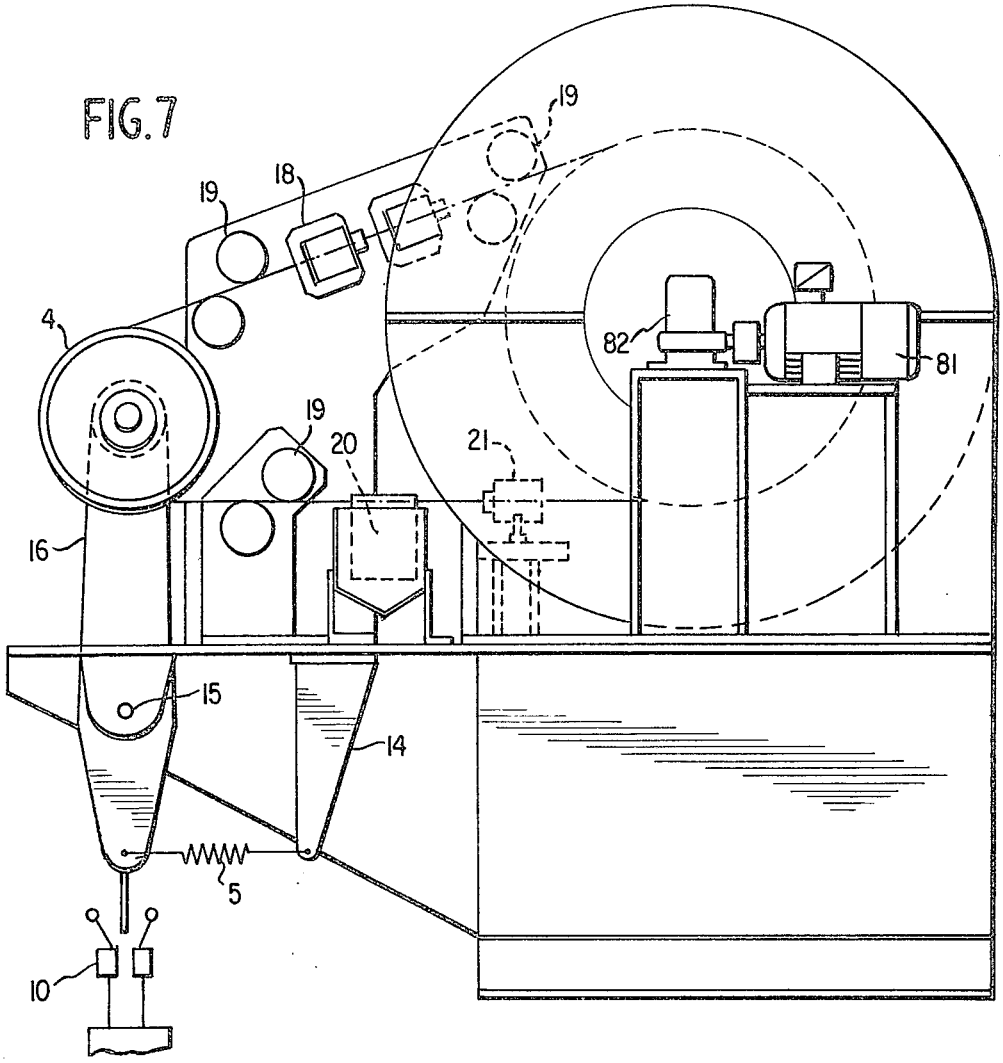
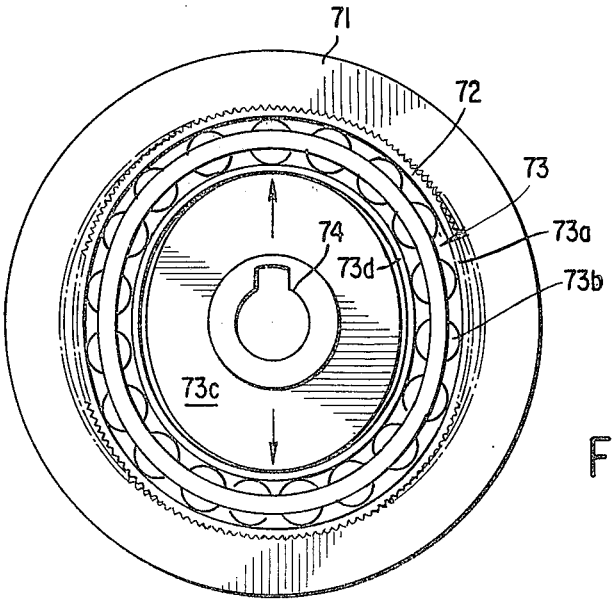
FIG.8

DEVICE FOR CONTINUOUSLY TREATING WIRES

BACKGROUND OF THE INVENTION

1. Field of the Invention

This invention relates generally to a device for continuously treating wire to be favorably used when various treatment is applied to the wire, such as for example, surface treatment, working treatment, and the like, as combined in a continuous process.

2. Description of the Prior Art

A wire, or metal wire, is often treated by an inline system including more than two treating processes. However, it is often necessary to provide for a substantial treating time for particular kinds of treatment, and in such cases, it is therefore very inconvenient in view of the space requirement and management of the treatment to cause the wire to proceed in a linear path.

Conventionally, various kinds of devices have been proposed for solving the aforementioned inconvenience by making the wire stay around for a predetermined period of time, such as diclosed, for example, in U.S. Pat. Nos. 3,098,109 and 3,050,267 or U.K. Pat. No. 928,435. All of these techniques employ a drum for winding up a proceding wire to cause it to remain wound thereabout for a predetermined treating time. However, the wire storing drums employed in these conventional techniques are all driven by their own driving means and, in this connection, they are bound with a serious disadvantage in that the device for controlling the driving means to operate in perfect harmony with the proceeding of the treating processes becomes very expensive.

On the other hand, in another conventional technique which employs a wire storing drum not equipped with its own driving means, the wire is usually wound around a single drum. However, in such single drum systems, the amount of the wire to be wound around the drum is relatively limited. In more detail, referring to FIG. 1 showing a single drum system, the wire at the side leading out from the drum is applied with a tension T2, while the wire at the side of the drum leading thereinto is applied with a tension T1 which is comparable with the tension T2. Since the wire is wound around the drum under the application of a relatively high tension, the friction between the windings of the wire and the drum is relatively high. Therefore, if a large amount of wire is wound around the drum, the windings laid upon the drum cannot shift from one end of the drum to the other, whereby the newly wound windings are laid over the preceding windings making it impossible to continue normal operation of the wire storing drum. It might be considered to form the winding up drum in a relatively steeply tapered fashion to meet with such inconvenience and to increase the storing amount of the single drum system, but in this case, slippage between the wire and drum becomes very large causing serious wearing of the drum so that it cannot stand long periods of operation.

SUMMARY OF THE INVENTION

Therefore, it is an object of this invention to solve the aforementioned problems and to provide a novel device of the type characterized herein which does not require a driving means for the wire-storing drum and which is of a compact structure, while affording a large capacity for provisionally storing wire for the purpose of continuously treating the same.

According to this invention, the foregoing object and others are accomplished by a device characterized by first and second winding-up drums supported in a manner to be freely and independently rotatable, means to guide a wire portion stretched between these first and second winding-up drums incorporating a mechanism to adjust the slackening of the wire portion and means to detect changes of such slackening, and means to control the relative rotations between the first and second winding-up drums.

According to a more detailed feature of this invention, the means for controlling the relative rotations between the first and second winding-up drums is adapted to normally maintain a constant ratio between the revolutional speeds of the drums, and to change this ratio in accordance with changes in the slackening of the wire portion stretched therebetween. The first and second winding-up drums preferably are carried by a common rotatable shaft, one being fixedly mounted, while the other is rotatably mounted on the shaft, and this shaft and drum rotatably mounted thereon are drivingly connected with each other through a variable speed gear.

According to still another feature of this invention, each of the first and second winding-up drums is tapered along its axis and is provided with a wire guide means at its larger end. In this case, the wire guide means may be a tapered flange firmly carried by the drum. However, as a more favorable structure, the wire guide means may be a ring held around the larger end portion of the drum and spaced therefrom, the ring being secured in a manner to be adjustable of its inclination relative to the axis of the drum. Furthermore, it is preferable that the ring is carried in a manner to be freely rotatable around its own axis so that no substantial friction is caused between the wire and the wire guide means guiding the wire to be laid on the drum as continuous windings.

According to a still further feature of this invention, the mechanism for adjusting the slackening of the wire portion may comprise a pulley carried by a pivotable lever having a spring force exerted thereon to apply a tension to the wire portion turned around the pulley and stretched between the first and second winding-up drums. In relation with this particular structural feature, the means for detecting the changes of the slackening of the wire portion stretched between the first and second winding-up drums preferably comprises a pair of limit switches adapted to be actuated by the lever when it has been pivoted, or overswayed, in either direction of rotation.

The relative rotations between the first and second winding-up drums may be controlled by employing any one of a number of conventionally known variable speed gears so that the drums can be rotated in perfect harmony whereby the same amount of wire is being wound around one of the two drums as is being led out from the other, while simultaneously keeping the slackened portion therebetween within proper limits to insure normal operation of the device. However, in the case of the structure wherein the first and second winding-up drums are carried by a common rotatable shaft, one being fixedly mounted while the other is rotatably mounted on the shaft, and the shaft and the rotatably mounted drum are drivingly connected with each other through a variable speed gear, it is particularly desirable that the variable speed gear is of the type which itself is known and comprises a rigid outer ring formed with an internal gear having a first number of teeth, a flexible inner ring formed with an outer gear having a second number of teeth, and an elliptical core to urge the inner ring radially outwardly to cause engagement of the outer gear with the internal gear at two diametrically opposite regions thereof, wherein the outer and inner rings are drivingly connected with the other drum and the shaft, respectively, and the elliptical core is driven by a power source through another variable speed gear. A variable speed gear of the type described herein is commercially available under the trademark of HARMONIC DRIVE.

BRIEF DESCRIPTION OF THE DRAWINGS

Various other objects, features and attendant advantages of the present invention will be more readily appreciated as the same becomes better understood from the following detailed description, when considered in connection with the accompanying drawings, in which like reference characters designate like or corresponding parts throughout the several views, and wherein:

FIG. 7 is an end view of the device shown in FIG. 6; and

FIG. 8 is a sectional view taken along the line 8—8 in FIG. 6, but shown on an enlarged scale.

DETAILED DESCRIPTION OF THE PREFERRED EMBODIMENTS

Figure 1:
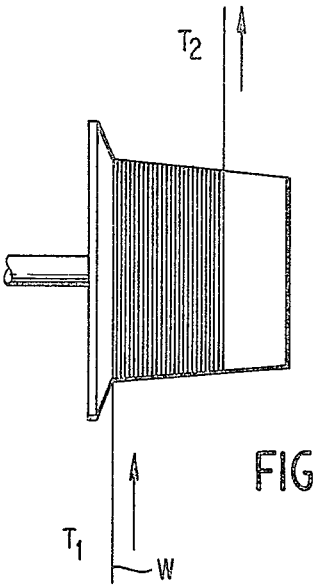
FIG. 1 is a diagrammatical view showing the manner of winding up wire with a single drum not equipped with a driving means.
Figure 2:
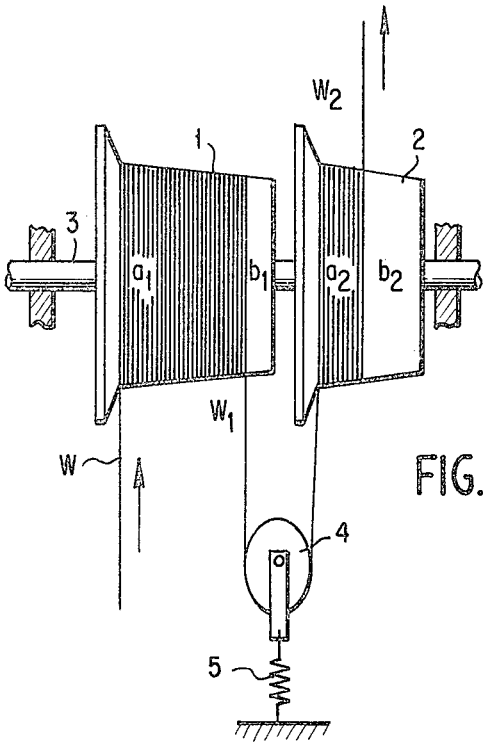
FIG. 2 is a diagrammatical view showing the manner of winding up a wire with a device incorporating two winding-up drums also not equipped with a driving means, and constructed according to this invention.
Figure 3:
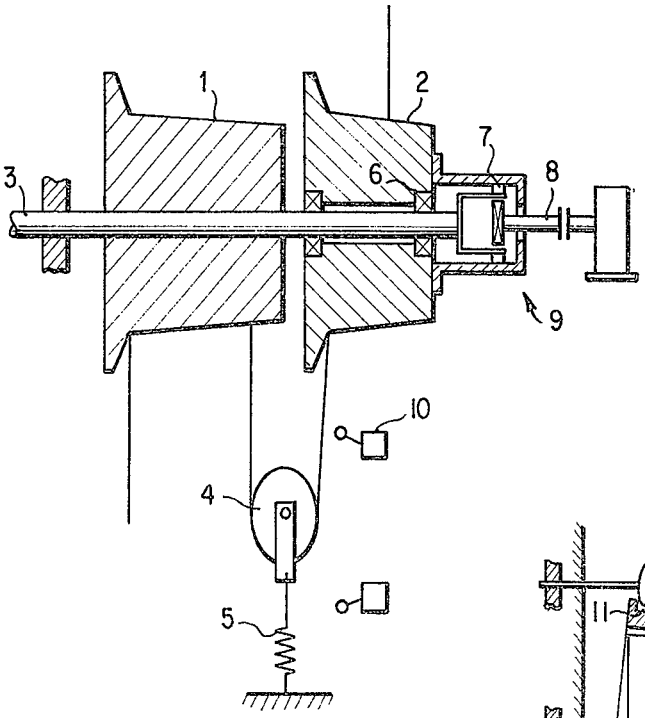
FIG. 3 is a diagrammatical view, shown partly in crosssection, of the structure of the device of FIG. 2, according to this invention.

Referring first to FIGS. 2 and 3 of the drawings, the principle of this invention will be explained. As previously indicated herein, the amount of the wire to be stored is largely limited when it is wound around a single drum not equipped with its own driving means. Therefore, this invention proposes a two drum system incorporating two winding-up drums which also are not equipped with driving means. In this system, a first drum 1 and a second drum 2 are firmly mounted on a common shaft 3 to be perfectly co-rotatable therewith. A wire W is first wound around the first winding-up drum 1 to form a number of windings thereon and is then turned around a wire guide means shown as a pulley 4 and a spring 5 resiliently connecting the pulley to a supporting base, and thereafter the wire is wound around the second winding-up drum 2 to form several windings thereon before it is finally led out from the wire storing device. The wire is designated as W as it is being fed to the first drum 1, as $W_1$ as it is led out from the first drum to the pulley 4, and as $W_2$ as it is led out from the second drum 2, for purposes of reference to areas of the wire transport.

In the device shown in FIG. 2, the second winding-up drum 2 is caused to rotate as the wire portion $W_2$ is led out from the leading-out side of the second winding-up drum 2 and, at the same time, the first winding-up drum 1 is driven in quite the same manner as the second winding-up drum 2. In this case, therefore, no substantial tension is applied to the wire portion $W_1$, which is automatically unwound from the first winding-up drum 1 and is rewound around the second winding-up drum 2 by way of the wire guide means. Thus, it will be appreciated that the windings carried around the first winding-up drum 1 can easily shift in the direction of its axis since no substantial tension is applied to the wire forming the last winding at the leading-out side thereof, whereby the amount of wire being stored on the first winding-up drum 1 can be optionally increased according to a required holding time of the wire. However, there is a problem to be solved in the actual operation of this device. The winding-up drums 1 and 2 must be tapered along their axis because the windings carried around each drum must be easily shifted in its axial direction as a winding is unwound at the leading-out end while a new winding is wound at the leading-in end thereof. Therefore, expressing the diameters of the first and second drums at the leading-in and leading-out ends by $a1$, $b1$ and $a2$, $b2$, respectively, the conditions $$a1 > b1$$

$$a2 > b2$$

must be satisfied. On the other hand, the rate of supplying the wire to the first and second winding-up drums must be equal to keep the operation of the device stable, and therefore, the condition $a1 = a2$ must be satisfied. Then, $a1$ should be larger than $b2$ or, in other words, the first drum must take in a length of wire of $a1\pi$ upon each rotation thereof while the second drum must lead out a length of wire of $b2\pi$ upon each rotation thereof, since the first and second drums are firmly mounted on the common shaft, causing an accumulation of wire of the amount of $(a1 - b2)\pi$ with each rotation of the drums, and finally making it impossible to carry on the operation of the device due to too much slackening of the wire occurring between the first and second drums.

Therefore, this invention further proposes to mount the second winding-up drum 2 rotatably on the shaft 3 by way of bearings 6 as shown in FIG. 3, and to provide a variable speed gear 9, including a gearing system 7 and a controlling mechanism 8 therefor, so as to transmit the rotation of the second winding-up drum 2 to the first winding-up drum 1 by modifying the transmission ratio therebetween. The modification of the transmission ratio is made by the controlling mechanism 8, which in turn is controlled by a detecting means 10, such as a limit switch adapted to detect changes in the slackening of the wire portion stretched between the first and second winding-up drums. The transmission ratio of the gearing system 7 is determined in consideration of the diameters of the first and second winding-up drums so that the winding-up rate of the wire by the first winding-up drum 1 is substantially equal to the leading-out rate of the wire from the second winding-up drum 2, thereby to keep the slackening of the wire stretched between the two drums substantially constant. However, since the winding-up drums are rotated at a relatively high speed, a little variation of the diameters or the effective diameters of the two winding-up drums will rapidly lead to a large variation of the slackening of the wire between the two drums. Therefore, it is necessary that the transmission ratio effected by the variable speed gear 9 be constantly adjusted by the controlling mechanism 8 to do fine adjustment of the transmission mechanism provided bby the gearing system 7.

Figure 4:
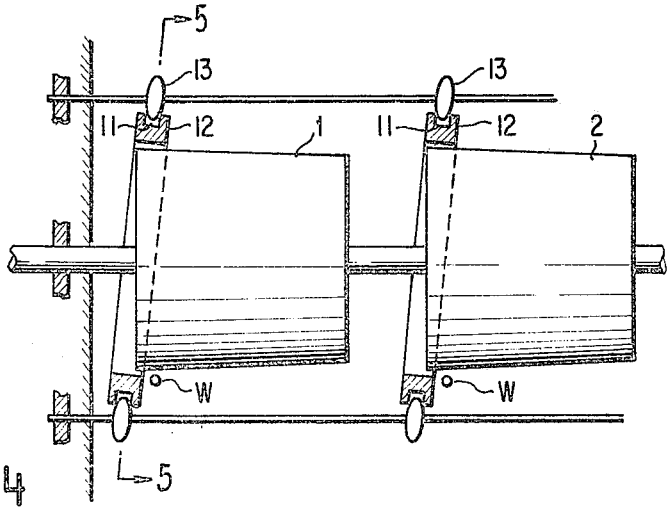
FIG. 4 is a diagrammatical view showing an embodiment of the wire guide means.
Figure 5:
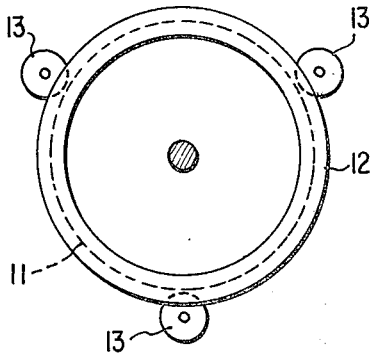
FIG. 5 is a view taken along the line 5—5 in FIG. 4.

In the devices shown in FIGS. 2 and 3, the winding-up drums 1 and 2 are each equipped at the wire leading-in end thereof with a flange formed as an integral part thereof. Although such a flange is properly tapered to guide the leading-in wire in a manner to be laid in close contact with the preceding winding and to apply an axial force to the total windings carried around the drum to shift them in the axial direction of the drum, such a wire guiding function effected by the fixed flange may not be sufficient in the case of the device according to this invention, because the wire portion stretched between the two drums is not applied with any substantial tension. In this case, therefore, it is desirable to employ a wire guide means such as shown in FIGS. 4 and 5. Of course, the wire guide means as shown in FIGS. 4 and 5 may preferably be employed for the first winding up drum 1, as it is shown in FIG. 4. This wire guide means comprises a ring 12 formed with an annular groove 11 extending along the outer peripheral portion thereof and a plurality of rollers 13 rotatably supporting the ring. By employing such a wire guide means and properly adjusting its inclination with respect to the axis of the drum, a required axial force is exerted on the wire as it is laid onto the peripheral surface of the drum in close contact with the preceding winding wound on the drum, whereby all of the windings carried around the drum are readily shifted as a whole unit in the axial direction of the drum as the leading-in and out of the wire to and from the drum proceeds.

Figure 6:
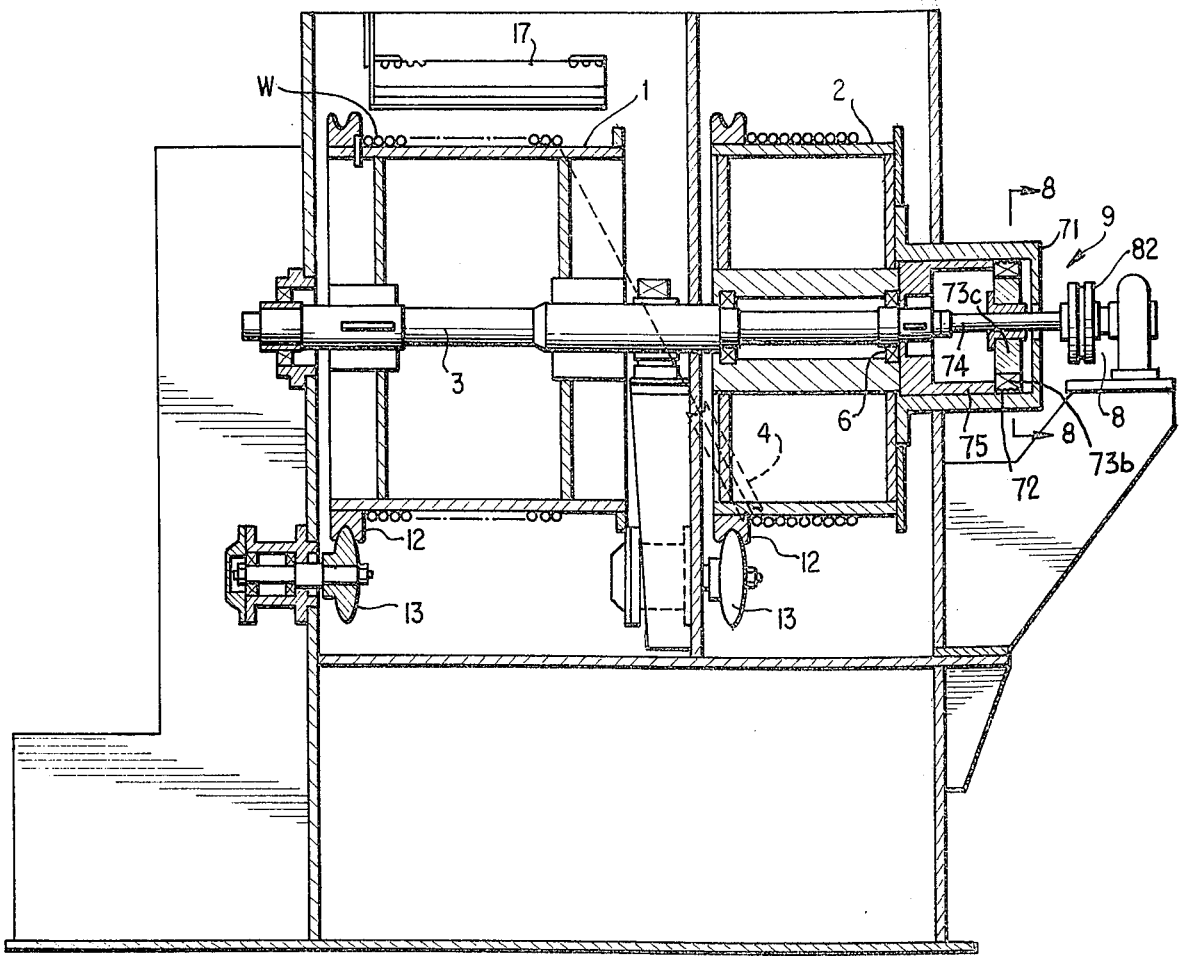
FIG. 6 is an elevational sectional view of another embodiment of the device, according to this invention.

FIGS. 6 – 8 show a more practical embodiment of the device according to this invention wherein the pulley 4 of the wire guide means is carried by a pivotable lever 16 which is pivotably mounted upon a pivot shaft 15 and is applied with a resilient force to rotate in a counterclockwise direction, as seen in FIG. 7, by the spring 5 connected to the lower end of the lever. The spring 5 is carried at its one and by a support 14 mounted to the frame of the device. From FIG. 7, it will be apparent how the limit switches 10 are operated when the lever 16 sways in either direction beyond a predetermined amount.

When the device is used to treat a metal wire chemically prior to the drawing process thereof, a spraying device 17 disposed above the first winding-up drum 1 is operated to spray a treating liquid, such as a phosphate, supplied from a reservoir, not shown. A first wiping nozzle 18 is provided between the first winding-up drum 1 and the pulley 4 to remove any excessive quantity of the unreacted treating liquid from the wire being led out from the first winding-up drum between guide rollers 19 to the pulley. The wire being received on the second winding-up drum 2, after having been turned around the intermediate pulley 4, may be subjected to a borax treatment in a borax reservoir 20, as well as a wiping treatment by a second wiping nozzle 21, if required.

The variable speed gear 9 employed in the embodiment shown in FIGS. 6–8 incorporates a variable speed transmission which itself is known and commercially available under the trademark HARMONIC DRIVE. This variable speed transmission, which is best shown in FIGS. 6 and 8, comprises a rigid outer ring 71 formed with an internal gear having a first number of teeth and a flexible inner ring 72 made of an elastic metal and formed with an outer gear having a second number of teeth less than said first number. The inner ring 72 is supported at the inside thereof by an elliptical core device 73 including an outer flexible ring **73*a* working as an outer race of a set of bearing balls 73*b* and an elliptical core 73*c* including a peripheral layer 73*d* working as an inner race of the ball bearings, the core 73*c* being connected with an output shaft 74 of a worm gearing 82. The outer gear portion of the inner ring 72 meshes with the internal gear portion of the outer ring 71 at two diametrically opposite regions, since the inner ring 72 is deformed to be elliptical shape by being supported by the elliptical core 73. Therefore, if the elliptical core 73 or the shaft 74 is driven at a rotational speed which is slightly different from that of the outer ring 71, the meshing region between the outer and inner rings shifts along the peripheries of the rings, and since the number of the teeth of the outer ring is different from that of the inner ring, a slight relative rotation takes place between the outer and inner rings. Therefore, the relative rotation between the outer and inner rings 71 and 72 can be optionally controlled by properly driving the elliptical core member in relation to the rotational speed of the outer ring or the inner ring. In the device shown in FIGS. 6 and 8, the outer ring 71 is drivingly connected with the second winding-up drum 2 while the inner ring 72 is drivingly connected to the shaft 3, by means of an annular member 75 splinedly connected to the right end of shaft 3 as seen in FIG. 6, which fixedly carries the first winding-up drum 1. Therefore, the ratio of the rotations of the first and second winding-up drums can be optionally controlled by driving the elliptical core device by a motor 81 by way of the worm gearing 82 in relation to the rotational speed of the drum 1 or 2**.

In operation, the wire W is first wound around the first winding-up drum 1, and is then turned around the pulley 4 and thereafter wound around the second winding-up drum 2. As the wire is led out from the leading-out side of the second winding-up drum 2, the second drum is rotated, whereby the first drum 1 is also rotated by way of the variable speed gear 9 keeping a rotational speed having a predetermined ratio relationship with the rotational speed of the second winding-up drum 2. This ratio is controlled by the driving speed of the motor 81, which is controlled by the actuation of the limit switches 10, so that the amount of the slackened portion of wire stretched between the two drums is constantly kept within a predetermined range.

Although a particular variable speed gear, such as called HARMONIC DRIVE, is employed in the embodiment shown and described above, other types of variable speed gears may of course be employed in the device according to this invention, and therefore, it is to be noted that this invention should not be limited to those embodiments incorporating this particular variable speed gear.

Obviously, many modifications and variations of the present invention are possible in light of these teachings. It is to be understood therefore that the present invention may be practiced within the scope of the appended claims otherwise than as specifically described herein.

What is claimed as new and desired to be secured by Letters Patent of the United States is:

1. A device for continuously treating wire comprising:

a first freely rotatable drum for winding said wire thereon;

a second drum for winding said wire thereon being freely rotatable independently of said first drum;

means for rotating the first and second drums relative to each other;

means for guiding a portion of said wire stretched between said first and second drums;

means for detecting the slackening of said wire portion stretched between said first and second drums;

means responsive to said detecting means for adjusting the slackening of said wire portion stretched between said first and second drums; and means for controlling the relative rotations of said first and second drums.

2. A device according to claim 1, wherein said means for controlling the relative rotation between said first and second drums comprises variable speed gearing which normally maintains a constant ratio between the revolutional speed of said first and second drums by changing said ratio in accordance with changes of the slackening of said wire portion stretched between said first and second drums.

3. A device according to claim 1, wherein said first and second drums are carried by a common rotatable shaft, one being fixedly and the other being rotatably mounted on said shaft, and said shaft and said other drum are drivingly connected with each other through said means for controlling the relative rotations of said first and second drums which comprises a variable speed gear.

4. A device according to claim 1, wherein each of said first and second drums is tapered along its axis and is provided with a wire guide means at its larger end.

5. A device according to claim 4, wherein each of said wire guide means of said first and second drums is a tapered flange firmly carried by the respective drums.

6. A device according to claim 4, wherein each of said wire guide means of said first and second drums is a ring surrounding the larger end portion of the drum in spaced relation thereto being adjustable in its inclination to the axis of its respective drum.

7. A device according to claim 6, wherein each of said rings is freely rotatable about its axis.

8. A device according to claim 1, wherein said means for detecting the slackening of said wire portion comprises a pulley and a pivotable lever carrying said pulley, said lever being biased by spring means for exerting a spring force to apply a tension to the wire portion turned around said pulley and stretched between said first and second drums.

9. A device according to claim 8, wherein said means for detecting the changes in the slackening of the wire portion stretched between said first and second drums additionally comprises a pair of limit switches adapted to be actuated by said lever upon pivotal movement in either direction beyond a predetermined point.

10. A device according to claim 3, wherein said variable speed gear comprises:

a rigid outer ring formed with an internal gear having a first number of teeth;

a flexible inner ring formed with an outer gear having a second number of teeth; and an elliptical core to urge said inner ring radially outwardly to cause said outer gear to engage said internal gear at two diametrically opposite regions thereof, wherein said outer and inner rings are drivingly connected to said other drum and said shaft, respectively, and said elliptical core is driven by a variable speed power source.

* * * * *